US011155379B2

(12) United States Patent
Xoy et al.

(10) Patent No.: US 11,155,379 B2
(45) Date of Patent: Oct. 26, 2021

(54) CONTAINER APPARATUS

(71) Applicant: Colgate-Palmolive Company, New York, NY (US)

(72) Inventors: Oscar Xoy, New Brunswick, NJ (US); Scott Demarest, Basking Ridge, NJ (US); Vijay Rajen, Cincinnati, OH (US); Trivikram Belagod, Cincinnati, OH (US); Zachary Nelson, West Chester, OH (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 16/229,175

(22) Filed: Dec. 21, 2018

(65) Prior Publication Data

US 2020/0198826 A1 Jun. 25, 2020

(51) Int. Cl.
*B65D 1/44* (2006.01)
*B65D 1/46* (2006.01)
(Continued)

(52) U.S. Cl.
CPC ..... *B65D 1/023* (2013.01); *B65D 1/0207* (2013.01); *B65D 1/0261* (2013.01); *B65D 1/40* (2013.01);
(Continued)

(58) Field of Classification Search
CPC .. B65D 1/46; B65D 1/023; B65D 2501/0081; B65D 2501/0018; B65D 2501/0036; B65D 2501/0027; B65D 1/44
(Continued)

(56) References Cited

U.S. PATENT DOCUMENTS 3,171,412 A * 3/1965 Braun ..... A61J 1/00 604/244
3,804,139 A * 4/1974 Kimm ..... B65D 1/46 215/42
(Continued)

FOREIGN PATENT DOCUMENTS

CA 2556691 A1 * 9/2004 ..... B65D 1/0223
EP 3028950 6/2016
(Continued)

OTHER PUBLICATIONS

International Search Report and the Written Opinion of the International Searching Authority issued in International Application PCT/US2019/066468 dated May 7, 2020.

*Primary Examiner* — Allan D Stevens

(57) ABSTRACT

A container has a container body extending along a longitudinal axis from a bottom end to a top end. The container body may define an internal cavity for holding a substance. The container body may include one or more shoulders, such as a first and/or second shoulder (e.g., axial shoulder). The shoulders may be located at the top end of the container. The container may include a neck located (e.g., nesting) between the first and second axial shoulder. The neck may be configured to accept a closure device. The neck may have an inner surface that defines a passageway into the internal cavity. The container may include one or more impact absorbing regions, such as a first axial impact absorbing region. The first axial impact absorbing region may be configured to absorb an axial force applied to the first axial shoulder and/or the second axial shoulder.

15 Claims, 16 Drawing Sheets

(51) Int. Cl.
*B65D 1/02* (2006.01)
*B65D 1/40* (2006.01)

(52) U.S. Cl.
CPC ..... *B65D 2501/0027* (2013.01); *B65D 2501/0036* (2013.01); *B65D 2501/0081* (2013.01)

(58) Field of Classification Search
USPC ..... 215/42; 222/540
See application file for complete search history.

(56) References Cited

U.S. PATENT DOCUMENTS 6,079,580 A * 6/2000 Garton ..... B65D 88/128 206/509
6,431,406 B1 * 8/2002 Pruett ..... B65D 1/0292 215/900
D527,645 S * 9/2006 Pedmo ..... B65D 1/0223 D9/542
8,813,996 B2 8/2014 Steih et al.
RE46,047 E * 7/2016 Higgins ..... D23/202
2006/0096942 A1 5/2006 Lane
2007/0114200 A1 5/2007 Lane
2007/0170144 A1 * 7/2007 Lane ..... B65D 1/0223 215/383
2007/0210028 A1 * 9/2007 Heisner ..... B65D 1/0223 215/384
2009/0095702 A1 * 4/2009 Ungrady ..... B65D 1/0284 215/383
2010/0006535 A1 * 1/2010 Ogg ..... B65D 23/102 215/384
2015/0008210 A1 * 1/2015 Oshino ..... B65D 1/44 215/373
2017/0021956 A1 * 1/2017 Ring ..... B65D 1/0223
2019/0185210 A1 * 6/2019 Demarest ..... B65D 21/0238
2020/0189785 A1 * 6/2020 Fonseca ..... B65D 1/0207

FOREIGN PATENT DOCUMENTS

WO 2001/004009 1/2001
WO WO-2008130996 A1 * 10/2008 ..... B65D 1/0223
WO 2011/090659 7/2011

* cited by examiner

CONTAINER APPARATUS

BACKGROUND

Containers and other types of packaging are known for the retention and exhibition of fluids or gels such as cleaning products, fabric care products, oral care products, etc. Such containers are typically formed with a primary packaging having a shape and size selected to minimize weight and/or outer profile so as to maximize the quantity of containers receivable in a shipping carton. However, this primary packaging sacrifices structural integrity for other factors such as weight, size and aesthetics.

Thus, in order to ship such containers, the containers are often provided with a secondary or tertiary packaging to protect the container during transport. In some cases, the primary packaging is loaded into a shipping carton (secondary packaging) and the shipping carton is provided with a means to prevent further damage to the container during transport (tertiary packaging). For example, a cushioning material (e.g., loose-fill Styrofoam packing material or "packing peanuts," air-filled sacs, etc.) is inserted into the shipping carton to prevent free movement of the container during transport.

The packaging systems described above, however, are cumbersome and require the addition of additional packaging materials at various stages of transport—therefore increasing the manpower needed to transport goods to a consumer and creating extra steps to be completed by the shipper and any intermediary parties (e.g., third-party seller). Such increased manpower and steps often result in an increased overall cost of shipping the container. Further, in a situation where only a small quantity of containers is to be shipped, the containers are often loaded in a large shipping box, thereby using valuable space in a transport vehicle and reducing the quantity of items that can be shipped together.

BRIEF SUMMARY

The present invention may be directed, in one aspect, to a container apparatus. The container may be designed to hold and/or transfer one or more substances. The container is designed to withstand one or more forces exerted upon the container. For example, the container is designed to withstand a transverse or axial force exerted upon the container. The force may be exerted upon the container due to the container being dropped, via a stacking of the container, or the like. The container may be used during transport (e.g., e-commerce) and/or in a brick and mortar store.

In an aspect the container may include a container body. The container body may extend along a longitudinal axis, for example, from a bottom end of the container to a top end of the container. The container body may define an internal cavity for holding a substance, such as a fluidic substance, a solid (e.g., a powder and/or a tablet), a gas, etc. The container body may include one or more shoulders, such as a first and/or second shoulder (e.g., axial shoulder). The shoulders may be located at the top end of the container. The container may include a neck. The neck may be located (e.g., may nest) between the first and second axial shoulder. The neck may be configured to accept a closure device. The neck may have an inner surface, for example, that defines a passageway into the internal cavity. The container may include one or more impact absorbing regions, such as a first axial impact absorbing region. The first axial impact absorbing region may be configured to absorb an axial force applied to the first axial shoulder and/or the second axial shoulder.

In an aspect the container may include a container body. The container body may have a bottom end and a top end. The container body may define an internal cavity, for example, for holding a fluidic substance, a solid (e.g., a powder and/or a tablet), a gas, etc. The container body may include one or more shoulders. For example, the container body may include first and/or second axial shoulders at the top end. The first axial shoulder may include a first shoulder rib. The first shoulder rib may protrude from a top surface of the first axial shoulder. The second axial shoulder may include a second shoulder rib. The second shoulder rib may protrude from a top surface of the second axial shoulder. The first and second axial shoulders may be spaced apart from one another, for example, to form a valley therebetween. A neck may nest between the first and second axial shoulders, for example, in the valley. The neck may be configured to accept a closure device. The neck may have an inner surface that may define a passageway into the internal cavity.

In an aspect the container may include a container body. The container body may extend along a longitudinal axis, for example, from a bottom end to a top end. The container body may define an internal cavity for holding a fluidic substance, a solid (e.g., a powder and/or a tablet), a gas, etc. The container body may include a neck nesting below an outer surface of the container body. The neck may be coupled to a closure device. The neck may have an inner surface that defines a passageway into the internal cavity. The container may include one or more impact absorbing regions. For example, the container may include one or more axial impact absorbing regions configured to absorb an axial force applied to the container body, one or more transverse impact absorbing regions configured to absorb a transverse force applied to the container body, and/or one or more oblique impact absorbing regions configured to absorb an axial and/or transverse force applied to the container body.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
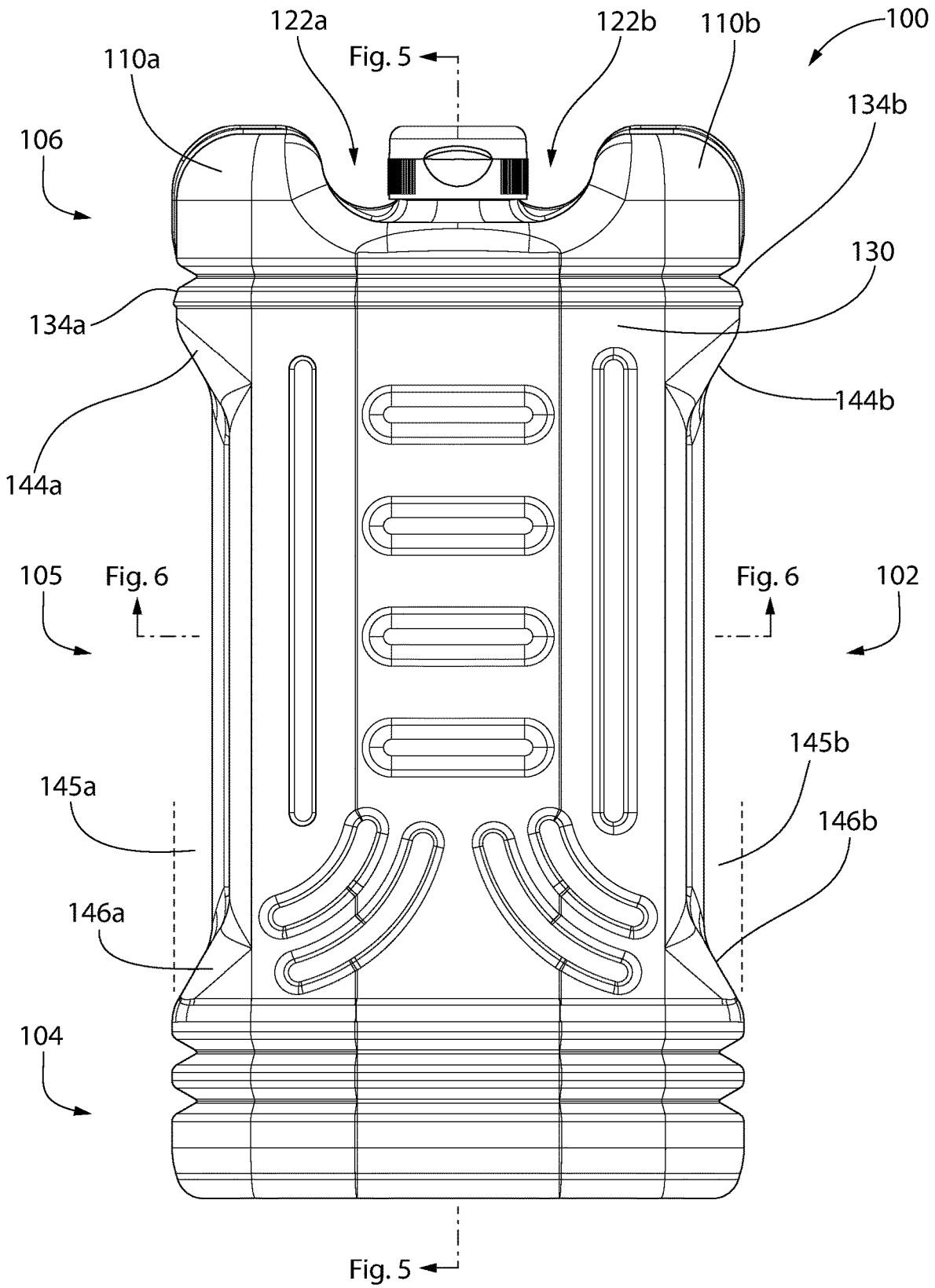
FIG. 1 is a front view of an example container as described herein.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

A proposed container for storing, transferring, etc., one or more substances is described herein. The container may store, transfer, etc., liquids and/or gels. For example, the container may store, transfer, etc., cleaning liquids. The liquids (e.g., cleaning liquids) may have a freezing temperature that is below 32 degrees Fahrenheit. In other examples the liquids may have a freezing temperature that is below other temperatures, such as below 20 degrees Fahrenheit, 10 degrees Fahrenheit, etc. The container may store, transfer, etc., solids and/or gases. For example, the container may store, transfer, etc., solids in a powder form, a tablet form, as well as one or more other forms.

The proposed container incorporates features that work together to provide protection (e.g., additional protection) of the liquids, gels, solids, and/or gases. The proposed container incorporates features that work together to provide improved package performance, for example, for when the container is subjected to severe conditions typical of over-the-road transport, distribution center processing/handling, etc. The features of the proposed container are intended to prevent and/or limit the damage to the container as well as the contents stored and/or transferred in the container. A consideration of the proposed container is to improve package performance for e-commerce distribution and shipping, although other uses of the container may be provided.

The proposed container may include one or more shoulders on one or more surfaces of the container. In addition, or as an alternative to the shoulders, the container may include one or more absorbing (e.g., shock absorbing, impact absorbing, etc.) regions. The shoulders and/or the absorbing regions may be used to prevent, limit, etc., damage, loss, or the like to the contents stored and/or transferred by the container. Further, the shoulders and/or the absorbing regions may be used to prevent, limit, etc., damage to one or more parts of the container itself. For example, the shoulders and/or the absorbing regions may be used to prevent, limit, etc., damage to a neck or body of the container.

An example container is shown on FIGS. 1-4 and 10-13. Container 100 may include a container body 102 having a top end 106, a bottom end 104, and a middle portion 105. The middle portion 105 may be located between the top end 106 and the bottom end 104. Container body 102 may extend along a longitudinal axis from bottom end 104 to top end 106. Container body 102 may define an internal cavity, such as internal cavity 111, shown on FIGS. 5 and 14. The internal cavity 111 may hold one or more substances, such as one or more fluidic substances, gels, solids (e.g., powder and/or tablets), gases, combinations of one or more of the substances, or the like.

The container body 102 may include one or more shoulders, such as shoulders 110*a*, 110*b*. As shown on FIGS. 1 and 10, first shoulder 110*a* and/or second shoulder 110*b* may be axial at the top surface of the shoulder. One or more surfaces of first shoulder 110*a* and/or second shoulder 110*b* (including all surfaces of shoulders 110*a*, 110*b*), however, may be formed in any shape or form factor to protect the container 100 and/or the contents stored/transferred within container 100. For example, the surfaces of the shoulders 110*a*, 110*b* may be linear, axial, smooth, rough, etc., and/or a combination therewith.

Figure 10:
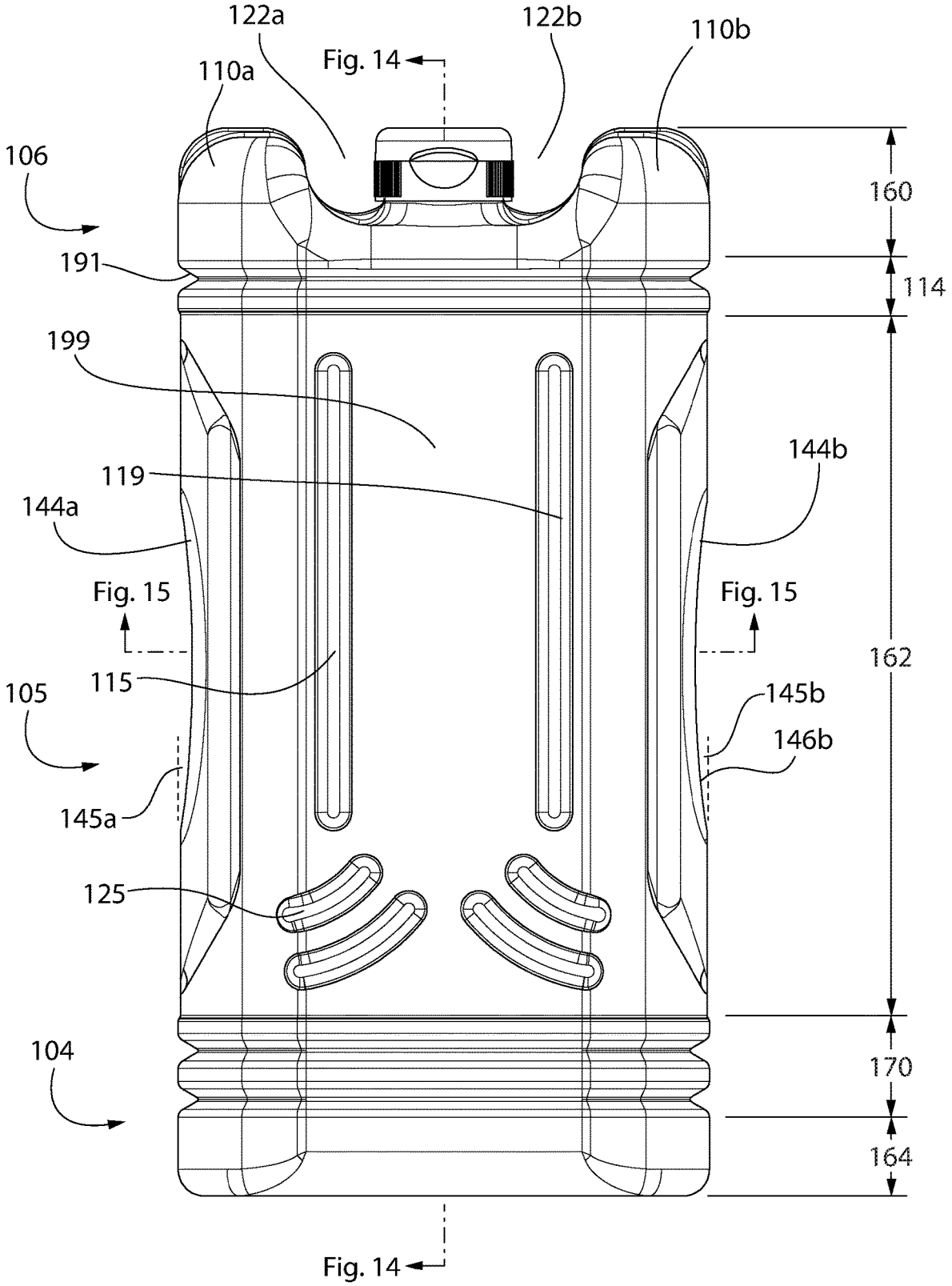
FIG. 10 is a front view of another example container.

Shoulders 110*a*, 110*b* may include grooves, such as outward grooves 120*a*, 120*b*, also referred to herein as first and second shoulder ribs, (FIGS. 2 and 11) and/or inward grooves. Shoulders 110*a*, 110*b* may be located on a top end 106 of container 100, as shown on FIGS. 1 and 10. Although FIGS. 1 and 10 show shoulders 110*a*, 110*b* being located on top end 106, shoulders 110*a*, 110*b* may be found on one or more ends, walls, and/or surfaces of container 100. For example, shoulders 110*a*, 110*b* may be found on top end 106 of container 100, on bottom end 104 of container 100, and/or on middle portion 105 of container 100. Shoulders 110*a*, 110*b* may be found on front wall 130 of container 100 and/or on rear wall 132 (FIGS. 3 and 12) of container 100. Although the shoulders 110*a*, 110*b* are shown as extending outward from container body 102, shoulders 110*a*, 110*b* may be inverted in some examples.

Shoulders 110*a*, 110*b* may be integrally formed with container 100, such as with container body 102. One or more of the shoulders 110*a*, 110*b* may be attached to the container body 102. Shoulders 110*a*, 110*b* may be made of the same material as one or more portions of the container 100. For example, shoulders 110*a*, 110*b* may be made of the same material as the container body 102. In other examples, shoulders 110*a*, 110*b* may be made of different materials of one or more portions of the container 100, such as container body 102.

Figure 2:
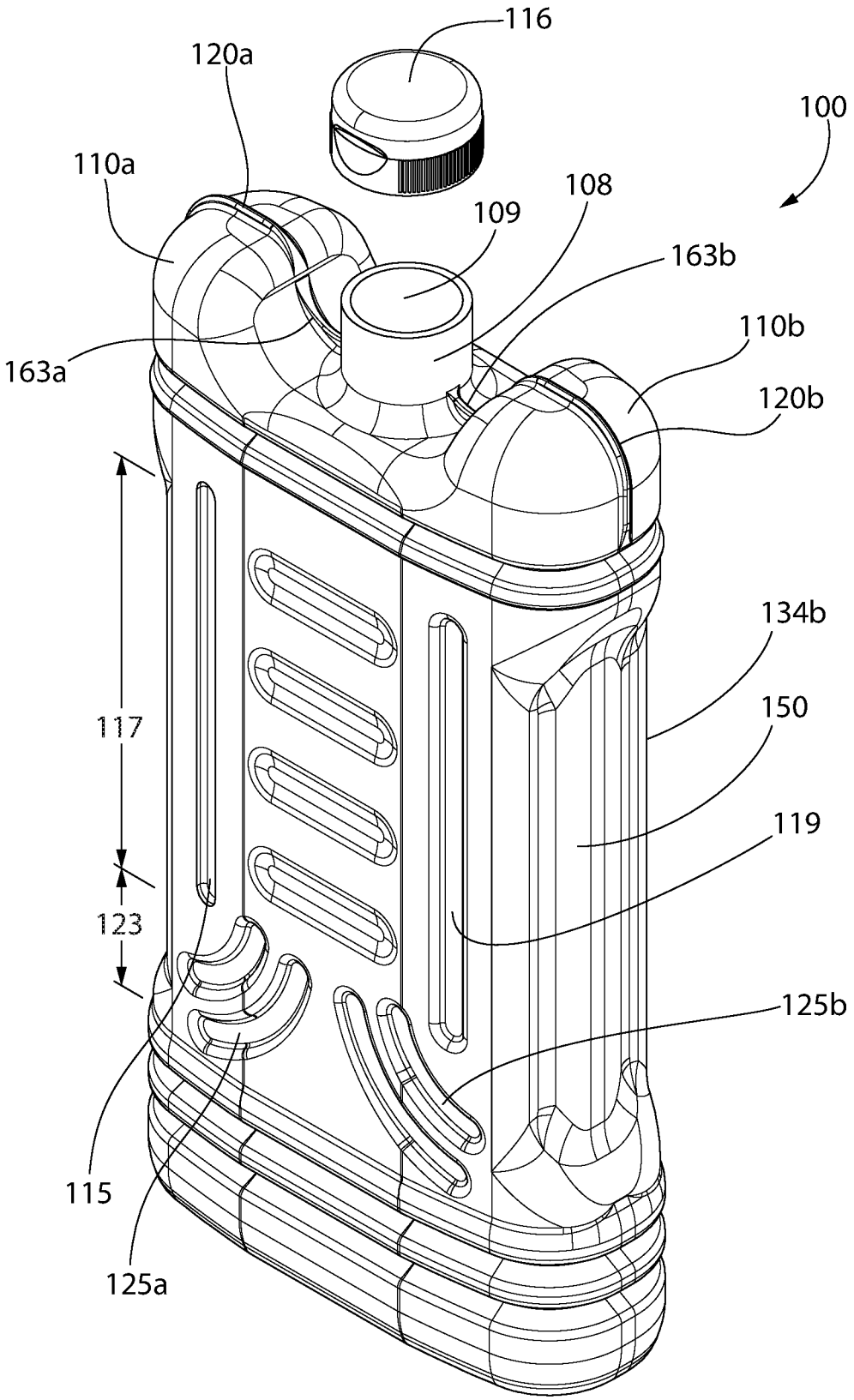
FIG. 2 is a front perspective view of the container shown on FIG. 1.
Figure 3:
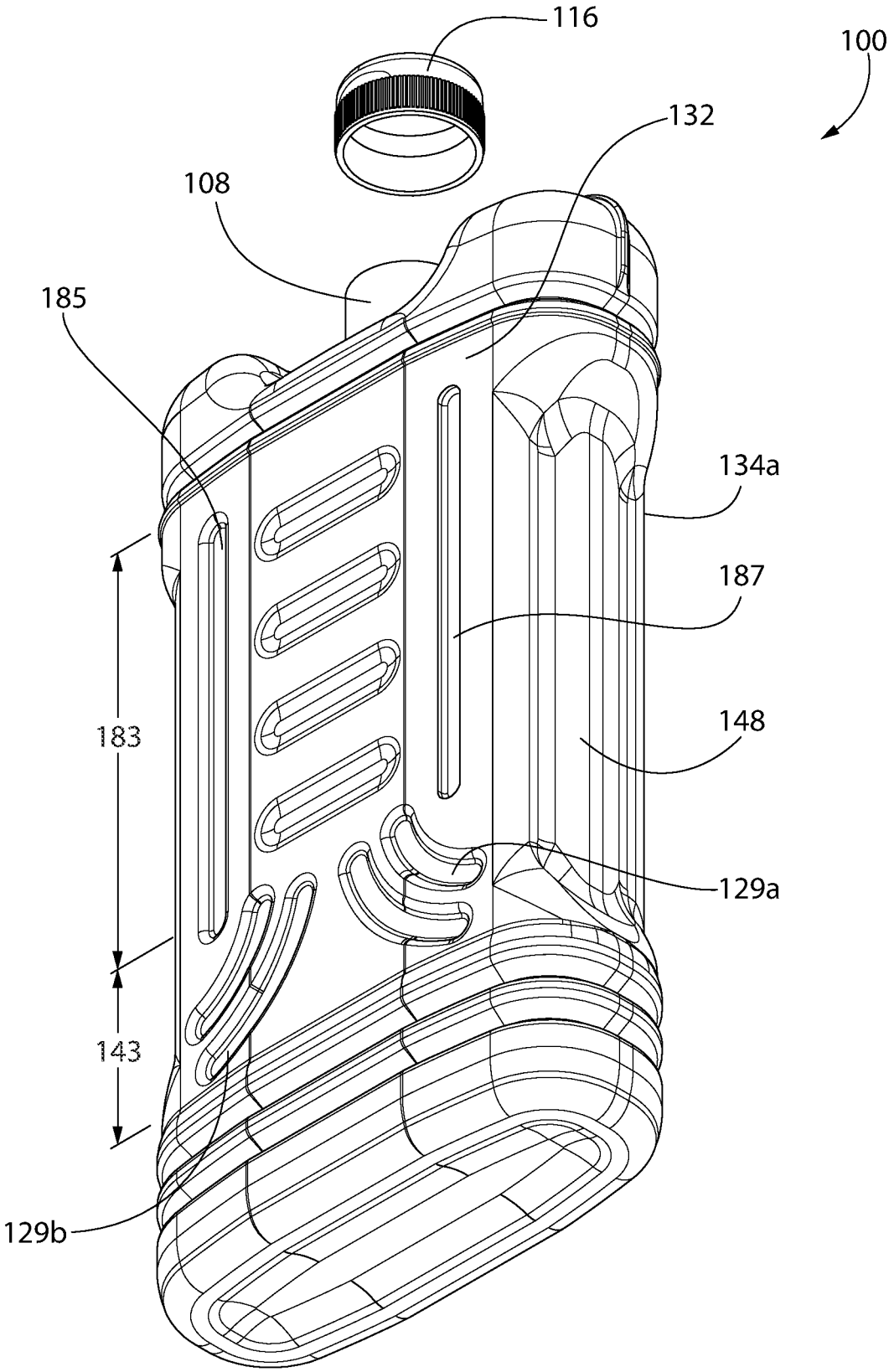
FIG. 3 is a rear perspective view of the container shown on FIG. 1.
Figure 11:
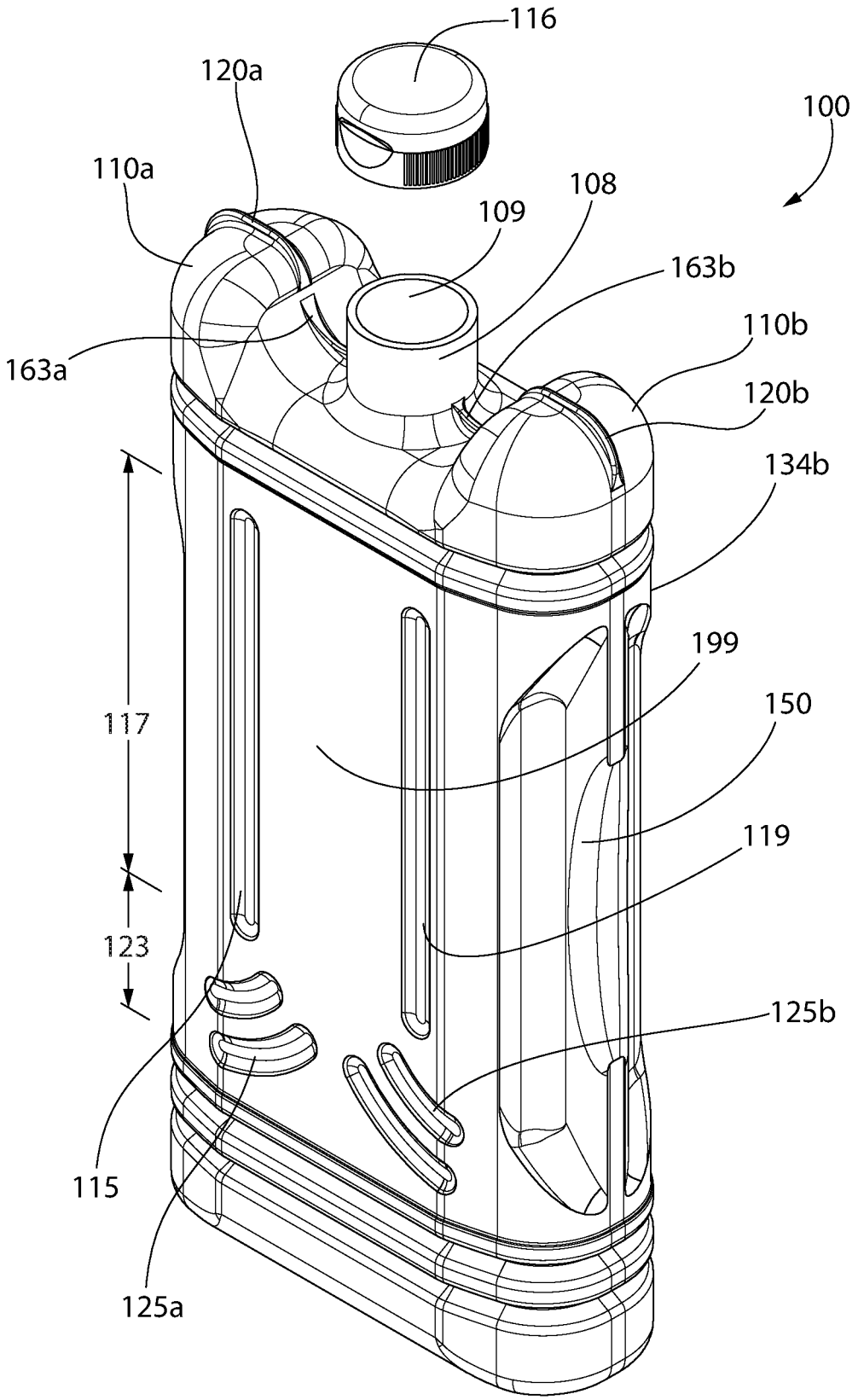
FIG. 11 is a front perspective view of the container shown on FIG. 10.
Figure 12:
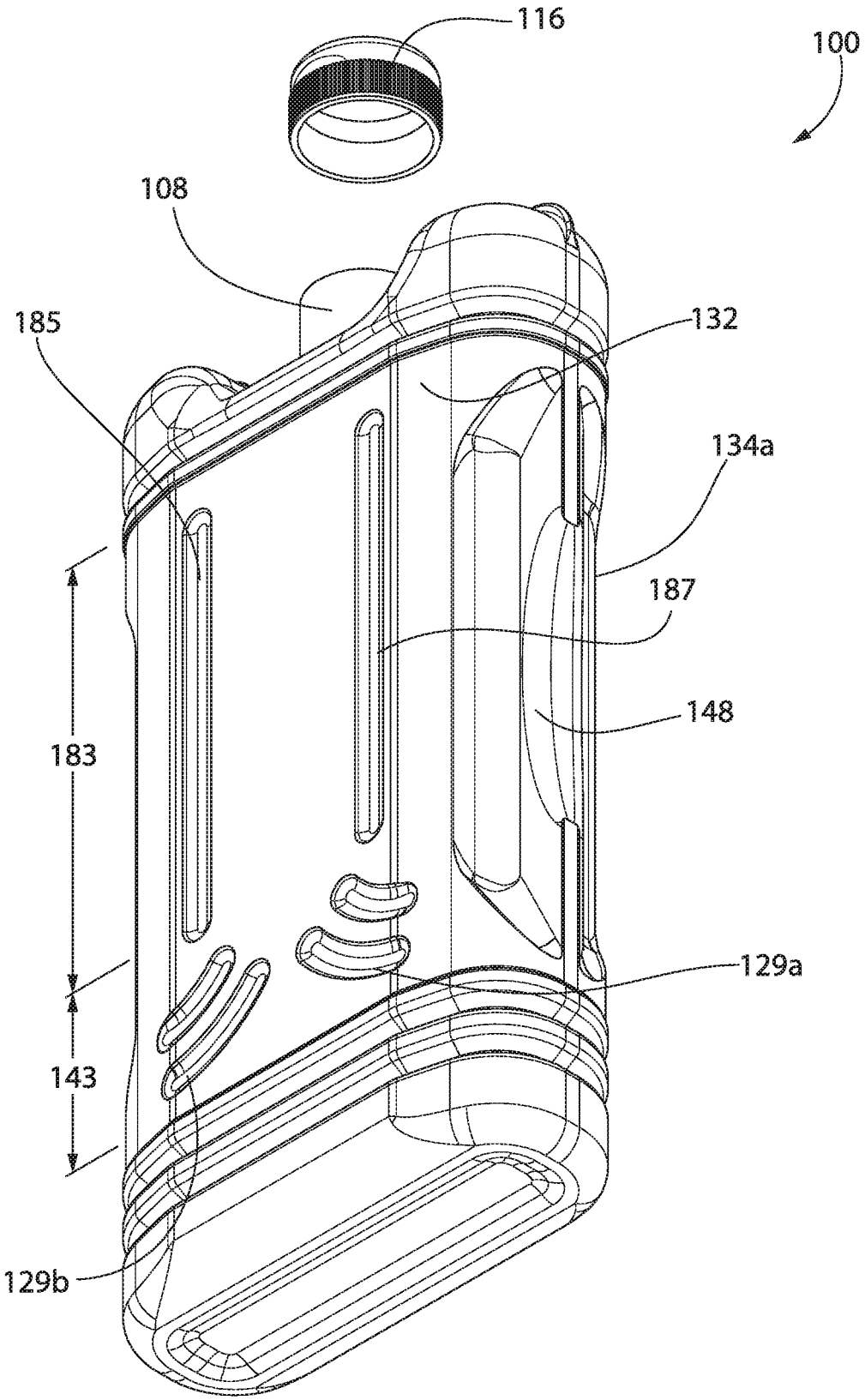
FIG. 12 is a rear perspective view of the container shown on FIG. 10.

As shown on FIGS. 2 and 11, container 100 may include a neck, such as neck 108. Neck 108 may be formed of the same, or different, materials as the shoulders 110*a*, 110*b* and/or one or more other portions of the container 100. As shown on FIGS. 5 and 14, neck 108 may have an inner surface 112 and an outer surface 118. The inner surface 112 of neck 108 may define a passageway, such as passageway 109. For example, the inner surface 112 of neck 108 may define a passageway 109 that provides access into internal cavity 111 of the container 100. Passageway 109 may be used for accepting fluidic, or other, substances, into the internal cavity 111 of the container 100. Passageway 109 and/or neck 108 may extend along a longitudinal axis of the container body 102. In other examples, passageway 109 and/or neck 108 may extend along an axis of the container body 102 that is other than longitudinal.

Neck 108 may extend from the container 100 (e.g., the container body 102). Neck 108 may extend away from the container 100 in a linear fashion, as shown in FIGS. 2 and 11. However, neck 108 may extend in one or more other fashions, such as extending within container body 102 and/or in a manner that is other than a linear fashion, such as in a zig-zag direction, a curved direction, etc. Although FIGS. 2 and 11 show neck 108 being located on top end 106 of the container 100, neck 108 may be located on the top end 106 of the container 100, the bottom end 104 of the container 100, or on one or more other ends (e.g., one or more side ends) of the container 100.

Neck 108 may be located adjacent to one or more of the shoulders 110*a*, 110*b*. For example, neck 108 may be located (e.g., may nest) between first shoulder 110*a* and second shoulder 110*b* of container 100. Neck 108 may be located between shoulders 110*a*, 110*b* to protect the vulnerabilities of neck 108 from a direct force. For example, due to the form factor of neck 108, neck 108 may be unable to take on a direct force (such as axial force AF, shown on FIGS. 4 and 13) without neck 108 losing some structural integrity. For example, neck 108 may be flattened, broken, opened, etc. if a direct force (such as axial force AF, shown on FIG. 4) is exerted upon neck 108.

Shoulders 110*a*, 110*b* may provide protection to the neck 108 against one or more forces exerted upon container 100. For example, neck 108 is less likely to receive a direct impact as a result of dropping container 100 and/or stacking container 100 when neck 108 is located (e.g., nested) between shoulders 110*a*, 110*b*. Container 100 is configured such that shoulders 110*a*, 110*b* receive all, some, or most of the impact of the force. Having container 100 receive all, some, or most of the impact of the force may preserve the integrity of neck 108 during such impact.

A closure device 116 (e.g., a cap, such as a twist or a flip-top cap) may be coupled to the container 100. For example, neck 108 may couple to closure device 116. The closure device 116 may be used to contain one or more substances (e.g., fluidic substances, solid substances, etc.) stored and/or transferred in container 100. The closure device 116 may be used to release one or more substances (e.g., fluidic substances, solid substances, etc.) from the container 100, for example, via neck 108.

The container body 102 may include one or more segments (e.g., axial segments). As shown on FIGS. 4 and 13, container body 102 may include a first axial segment 160, a second axial segment 162, and/or a third axial segment 164. The first axial segment 160 may define a first portion (e.g., top end 104) of the container 100 and/or the internal cavity 111. The first axial segment 160 may include one or more shoulders and/or one or more other structures. For example, the first axial segment 160 may include the first axial shoulder 110*a*, the second axial shoulder 110*b*, and/or the neck 108. The second axial segment 162 may define a second portion (e.g., middle portion 105) of the internal cavity 111. Third axial segment 164 may define a (e.g., a third) portion of container 100. Third axial segment 164 may define a portion of internal cavity 111 of the container 100, such as a third portion of the internal cavity 111. The third axial segment 164 may include a bottom portion (e.g., the bottom end 104) of the container 100. The bottom end 104 of the container 100 may be closed.

Container 100 may include one or more impact absorbing regions, such as one or more axial impact absorbing regions. The impact absorbing regions may be configured to absorb an impact to the container 100 upon one or more sides/surfaces of the container 100. For example, the impact absorbing regions may be axial impact absorbing regions configured to absorb axial forces exerted upon the container 100. The axial impact absorbing regions may be found on one or more walls of the container, such as the front wall 130, rear wall 132, sides walls 134*a*, 134*b*, etc. of the container 100. One or more impact absorbing regions may extend around a portion of one or more walls of the container 100. Also, or alternatively, one or more impact absorbing regions may extend around an entire perimeter of one or more walls of the container.

First impact absorbing region 114 and/or second impact absorbing region 170 may be an axial impact absorbing region. First axial impact absorbing region 114 and/or second axial impact absorbing region 170 may be configured to absorb an axial force applied to the top end 106 and/or bottom end 107 of container 100. First axial impact absorbing region 114 and/or second axial impact absorbing region 170 may be configured to absorb an axial force applied to the first shoulder 110*a* and/or the second shoulder 110*b*. Container 100 is not limited to first impact absorbing region 114 and/or second impact absorbing region 170 and may have additional (or fewer) impact absorbing regions in examples.

First impact absorbing region 114 may be located between the first axial segment 160 and the second axial segment 162. First impact absorbing region 114 may couple the first axial segment 160 and the second axial segment 162. Second impact absorbing region 170 may be located between the second axial segment 162 and the third axial segment 164. Second impact absorbing region 170 may couple the second axial segment 162 and the third axial segment 164.

The impact absorbing regions (e.g., axial impact absorbing regions) may include one or more designs used for absorbing an impact. For example, the axial impact absorbing regions, such as first impact absorbing region 114 and/or second impact absorbing region 170, may include a material that is weaker than the material found on the shoulders 110*a*, 110*b* or other portions of the container 100. The first impact absorbing region 114 and/or second impact absorbing region 170 may include one or more grooves, bellows, fins, ribs, etc., that may be used to absorb an impact to the container 100. For example, first impact absorbing region 114 may include one or more transverse grooves, such as transverse groove 191. The one or more grooves, such as transverse first groove 191, may circumscribe the container body 102. The one or more transverse first grooves 191 may be oriented perpendicular (e.g., substantially perpendicular) to the longitudinal axis. The grooves (e.g., transverse groove 191), bellows, fins, ribs, etc., may be compressible, foldable, etc. For example, the grooves, bellows, fins, ribs, etc., may be compressible, foldable along weaker material. The impact absorbing regions (e.g., axial impact absorbing regions), such as first impact absorbing region 114 and/or second impact absorbing region 170, may include one or more grooves, bellows, ribs, fins, etc. that may be used to absorb an impact, such as an axial impact, to the shoulders 110*a*, 110*b*, front wall 130, rear wall 132, side walls, bottom end 104, etc., of the container 100.

A second impact absorbing region 170 may be located between the second axial segment 162 and the third axial segment 164. Second impact absorbing region 170 may couple the second axial segment 162 and the third axial segment 164 to one another. Second impact absorbing region 170 may be an axial impact absorbing region. For example, the second impact absorbing region 170 may be configured to absorb an axial force applied to the third axial segment 164, for example. In other examples, second impact absorbing region 170 may be configured to absorb an impact (e.g., an axial impact) to the container 100 upon one or more other sides/surfaces of the container 100, including the top end 106, bottom end 104, side ends, etc., of the container 100.

As described herein, the impact absorbing regions may include one or more grooves. The grooves may be inward grooves, outward grooves, and/or a combination of inward grooves and outward grooves. The grooves may be configured to absorb a force, such as an impact force that is exerted upon the container 100. The force may be an axial force exerted upon the container 100, a transverse force exerted upon the container 100, etc. Using second impact absorbing region 170 as an example, second impact absorbing region 170 may include one or more grooves. As shown on FIGS. 4 and 13, second impact absorbing region 170 may include one or more grooves, such as transverse grooves 193. Transverse grooves 193 may circumscribe the container body 102. Transverse grooves 193 may be oriented in one or more directions on the container body 102. For example, transverse grooves 193 may be oriented perpendicular (e.g., substantially perpendicular) to the longitudinal axis of the container body 102.

First axial segment 160 may include one or more portions. For example, first axial segment 160 may include a main body 194. In an example, one or more shoulders (e.g., the first axial shoulder 110*a* and/or the second axial shoulder 110*b*) may extend upward from the main body 194 of the first axial segment 160. Neck 108 may extend upward from the main body 194. In other examples, shoulders 110*a*, 110*b* and/or neck 108 may be formed of the main body 194 of the first axial segment 160. Neck 108 may be flush with the main body 194, or the neck 108 may extend within the main body 194 of the first axial segment 160.

One or more ribs and/or grooves (e.g., inward ribs, outward ribs, or a combination of inward and outward ribs) may be located on one or more segments of the container 102. For example, one or more ribs may be located on the first axial segment 160 of the container, such as on one or more shoulders 110*a*, 110*b* and/or neck 108 of the container 100. The one or more ribs located on the shoulders 110*a*, 110*b* and/or neck 108 may include a neck rib, a shoulder rib, and/or a combination of neck ribs and shoulder ribs. For example, as shown on FIGS. 2 and 11, first axial segment 160 may include a first neck rib 163*a* and/or a second neck rib 163*b*.

The first neck rib 163*a* may protrude from a top surface of the main body 194 of the first axial section 160. The first neck rib 163*a* may be connected to an outer surface of the neck 108 and/or may be connected to the outer surface of a side of neck 108. The second neck rib 163*b* may protrude from the top surface of the main body 194 of the first axial section 160 and/or may be connected to the outer surface of a side (e.g., another side) of neck 108. The first neck rib 163*a* and the second neck rib 163*b* may be located on the same side of neck 108. In other examples, first neck rib 163*a* and second neck rib 163*b* may be located on opposite sides of the neck 108. Although FIGS. 2 and 11 show one neck rib 163*a*, 163*b* per side of neck 108, this is for illustration purposes. It is envisioned that container 100 may include zero, one, or more than one neck rib on each side of neck 108.

One or more gaps may exist between neck 108 and one or more of the shoulders 110*a*, 110*b*. The gaps may be through gaps. As an example, a first gap 122*a* may exist between the neck 108 and the first axial shoulder 110*a*. A second gap 122*b* may exist between the neck 108 and the second axial shoulder 110*b*. The gaps may have similar configurations as one another, such as having similar lengths, widths, and shapes as one another. However, in other examples the gaps 122*a*, 122*b* may have different configurations, such as having different lengths, widths, and shapes as one another.

One or more of the shoulders may terminate in a distal-most surface. For example, the first axial shoulder 110*a* and/or the second axial shoulder 110*b* may terminate in a distal-most surface. The distal-most surface may be in reference to the main body 194. The distal-most surface of the first axial shoulder 110*a* may be the same as the second axial shoulder 110*b*, or the distal-most surface of the first axial shoulder 110*a* may be different (e.g., lower or higher) than the second axial shoulder 110*b*.

One or more shoulder ribs may be located on one or more of the shoulders, such as shoulders 110*a*, 110*b*. The shoulder ribs may extend beyond the distal-most surface of the shoulders. For example, where the shoulder rib protrudes from a top surface of the shoulder, the first shoulder rib 120*a* may provide the distal-most surface of the first axial shoulder 110*a*.

First axial shoulder 110*a* may include a first shoulder rib 120*a* that protrudes from a surface (e.g., a top surface) of the first axial shoulder 110*a*. In such example, first shoulder rib 120*a* may extend beyond the distal-most surface of first axial shoulder 110*a*. In other examples, first axial shoulder 110*a* may include a shoulder rib that extends inward from a surface (e.g., top surface) of the first axial shoulder 110*a*. In these examples, first axial shoulder 110*a* may extend beyond the distal-most surface of first shoulder rib 120*a*. As shown in FIG. 2, shoulder ribs 120*a*, 120*b* may extend substantially around the perimeter of shoulders 110*a*, 110*b*. As shown in FIG. 11, however, shoulder ribs 120*a*, 120*b* may extend around less than the perimeter of shoulders 110*a*, 110*b*.

Container 100 may include one or more shoulders and/or one or more shoulder ribs. For example, container 100 may include a second axial shoulder 110*b*. Second axial shoulder 110*b* may include a second shoulder rib 120*b* that protrudes from a surface (e.g., a top surface) of the second axial shoulder. In other examples, second axial shoulder 110*b* may include a shoulder rib that may extend inward from a surface (e.g., a top surface) of the second axial shoulder 110*b*. In examples where the shoulder rib protrudes from a top surface of the shoulder, the second shoulder rib 120*b* may include the distal-most surface of the second axial shoulder 110*b*.

Figure 4:
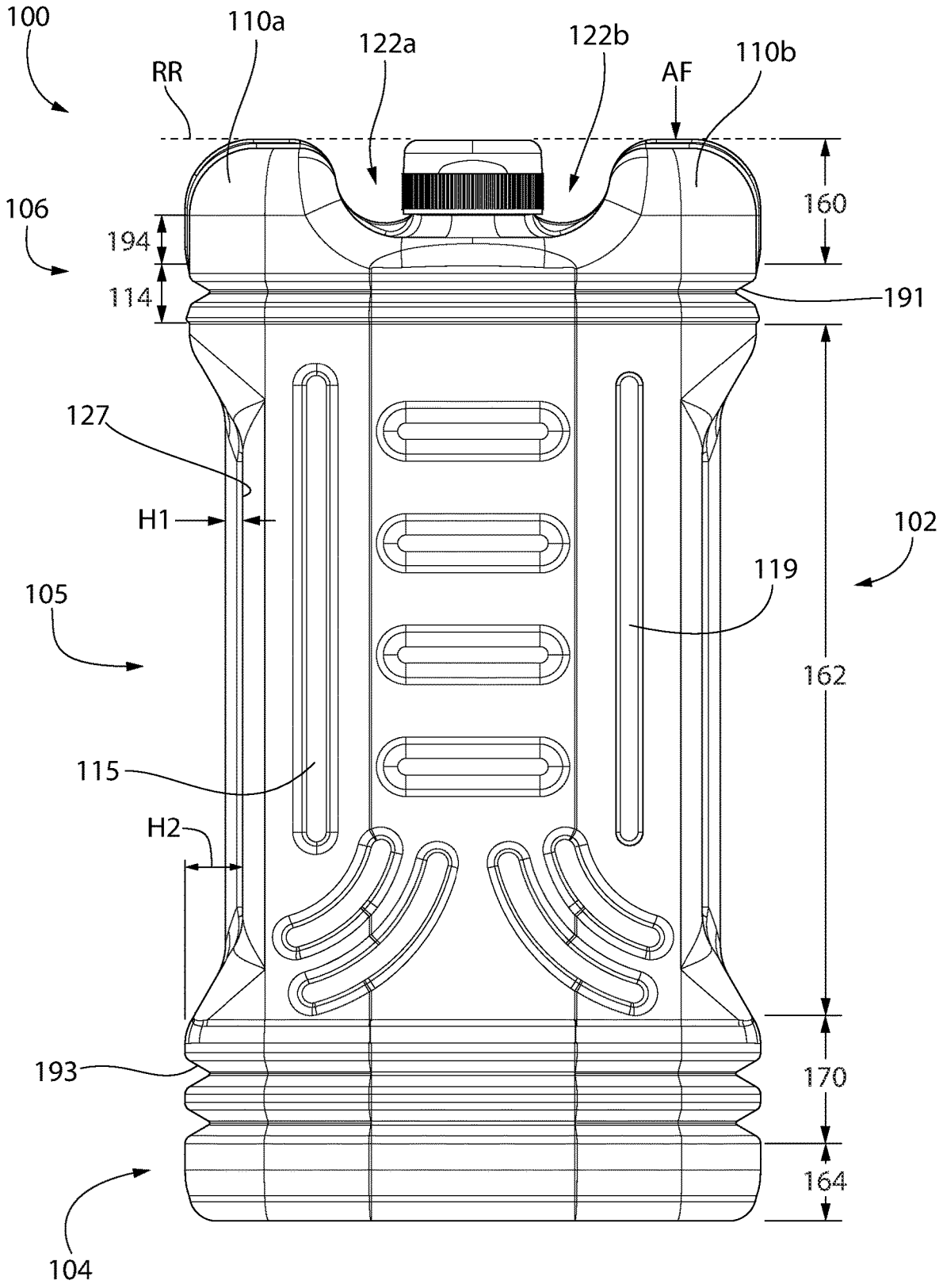
FIG. 4 is a rear view of the container shown on FIG. 1.
Figure 5:
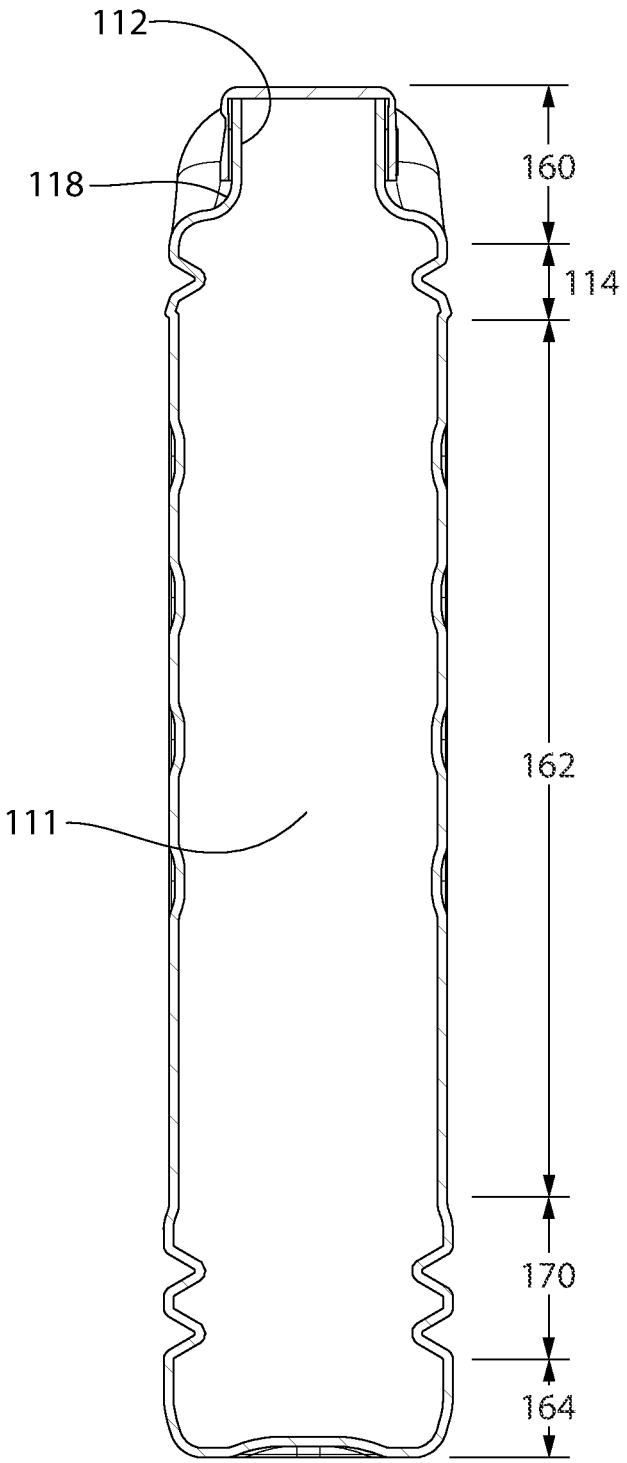
FIG. 5 is partial cross-sectional view of the side of the container shown on FIG. 1.
Figure 13:
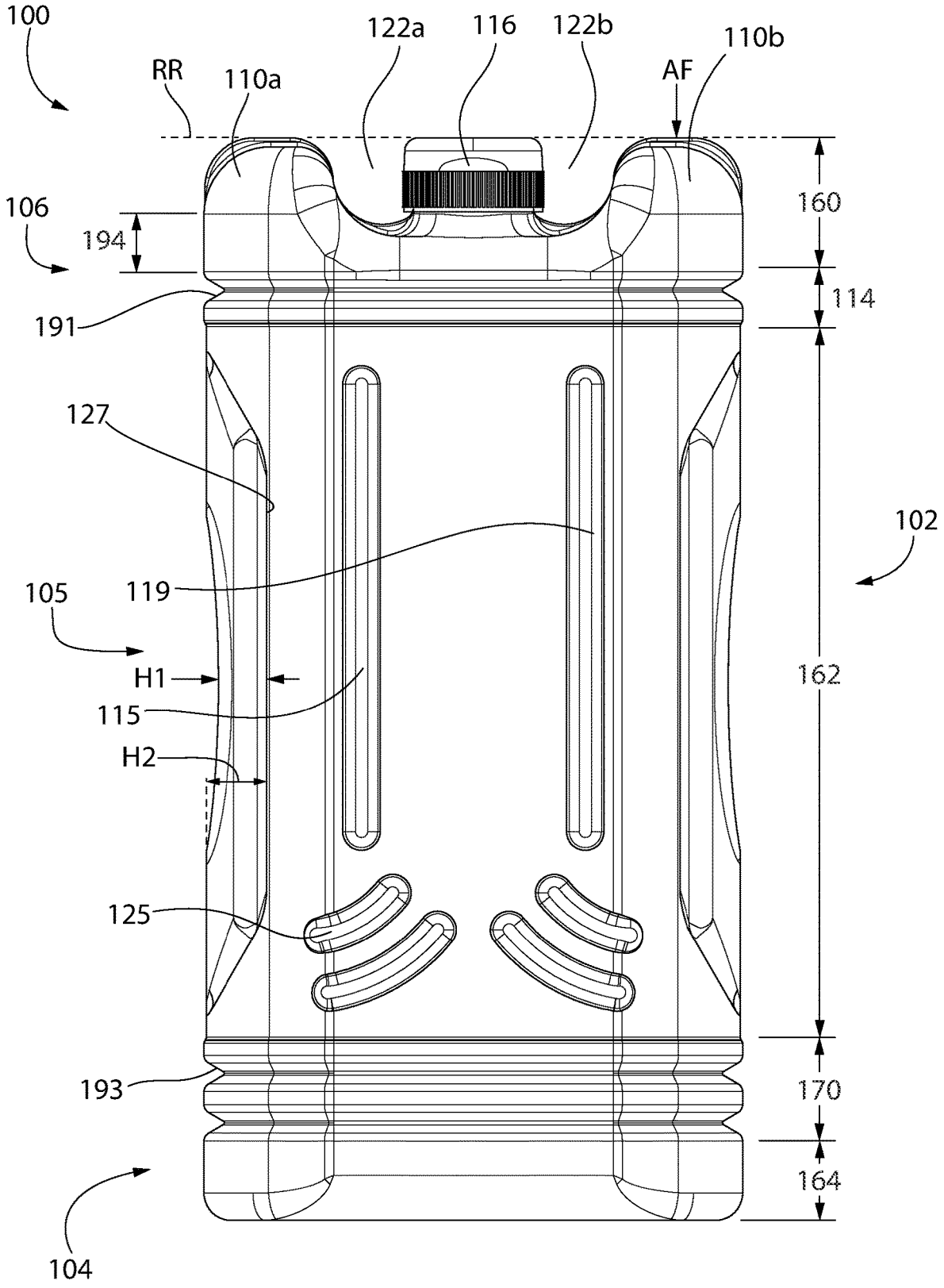
FIG. 13 is a rear view of the container shown on FIG. 10.
Figure 14:
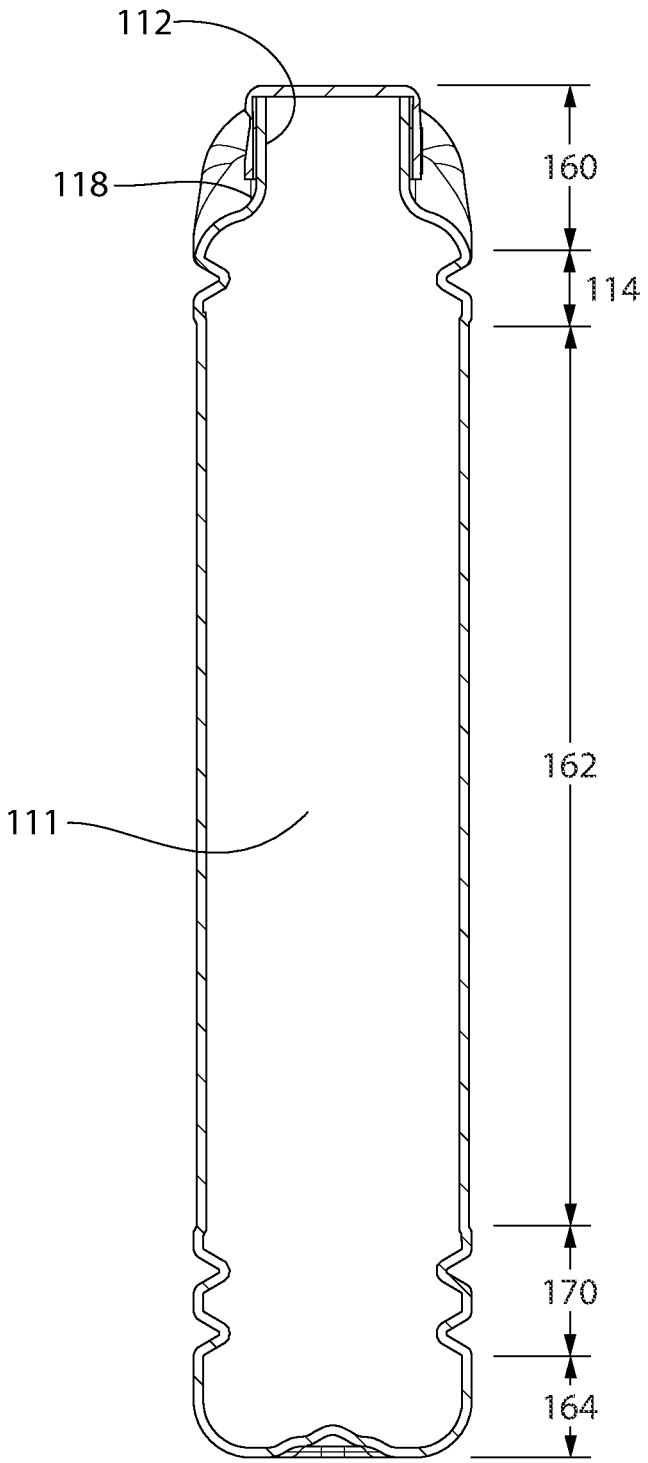
FIG. 14 is partial cross-sectional view of the side of the container shown on FIG. 10.
Figure 15:
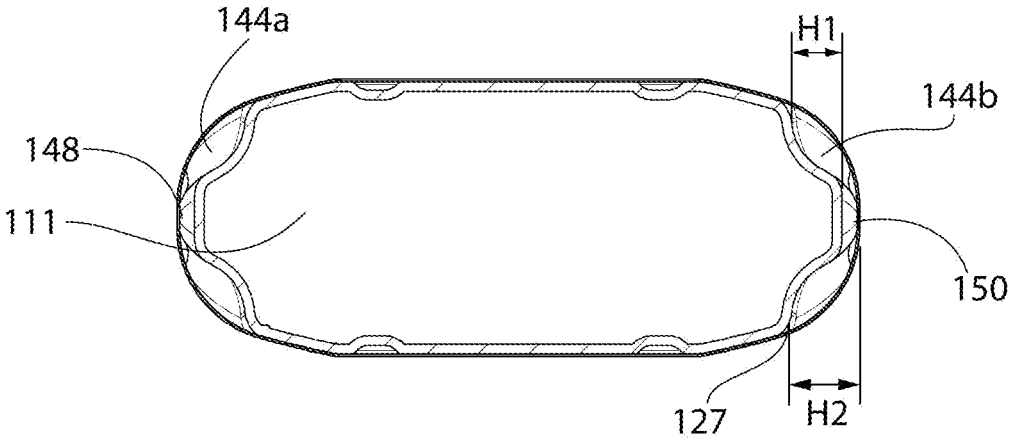
FIG. 15 is partial cross-sectional view of the top of the container shown on FIG. 10.
Figure 16:
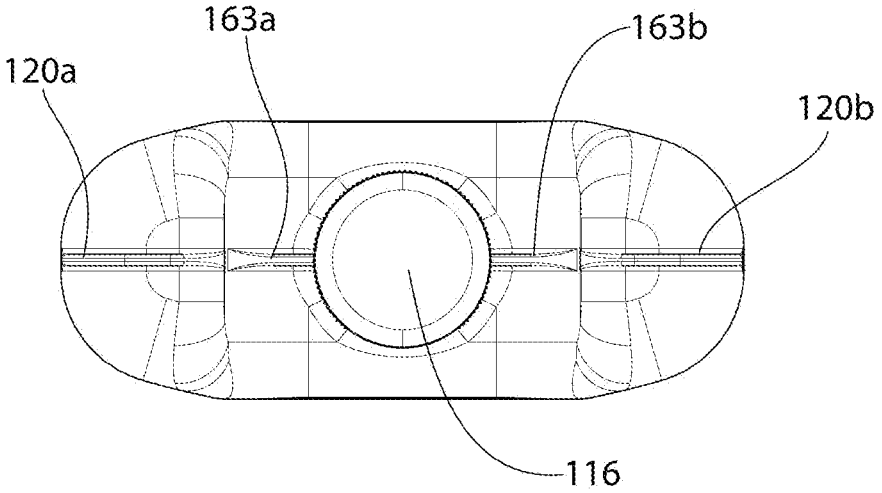
FIG. 16 is a top view of the container shown on FIG. 10.

Neck 108 may terminate in a distal-most surface. The distal-most surface of neck 108 may be in reference to the main body 194. As shown in FIGS. 4 and 13, reference plane, such as reference plane RR, may extend between and/or include the distal-most surfaces of the first axial shoulder 110*a* and/or second axial shoulder 110*b*. In examples where shoulders include one or more shoulder ribs, RR may extend between and/or include the distal-most surfaces of the one or more shoulder ribs. For example, RR may extend between and/or include the distal-most surfaces of first shoulder rib 120*a* and/or second shoulder rib 120*b*.

Neck 108 may terminate in a distal-most surface that is located at the reference plane RR extending between and/or including the distal-most surfaces of the first axial shoulder 110*a* and second axial shoulder 110*b*. Neck 108 may terminate in a distal-most surface that is below reference plane RR. In other examples, the neck 108 may terminate in a distal-most surface that is above (e.g., slightly above) the reference plane RR. For example, the neck 108 may terminate in a distal-most surface that is one millimeter to five millimeters (preferably one to three millimeters) above the reference plane RR. The reference plane RR may extend perpendicular (e.g., substantially perpendicular) to the longitudinal axis.

As described herein, neck 108 may be configured to couple to a closure device, such as closure device 116 (FIGS. 2 and 11). Closure device 116 may be a cap (e.g., a snap-on cap, twist cap, etc.), or any other device used to hold a substance within a container. Closure device 116 may be configured to open and/or close. Closure device 116 may include a distal most surface. The distal most surface of closure device 116 may be equivalent (e.g., substantially equivalent) to the distal most surface of neck 108. The distal most surface of closure device 116 may be different (e.g., further) than the distal most surface of neck 108.

The distal most surface of closure device 116 may be located at or below the reference plane RR, as described herein. For example, distal most surface of closure device 116 may be located at or below the reference plane RR that extends between and/or includes the distal-most surfaces of the first axial shoulder 110*a* and/or second axial shoulder 110*b*. The distal most surface of the closure device 116 may extend to (e.g., substantially to) a distal-most surface that is above (e.g., slightly above) the reference plane RR. For example, the closure device 116 may terminate in a distal-most surface that is one millimeter to five millimeters (preferably one to three millimeters) above the reference plane RR.

The container 100 (including one or more portions of the container 100, such as container body 102) may be formed of one or more structures. Container 100 may be an integrally-formed monolithic structure. Container 100 may be formed via known techniques such as blow-molding, injection molding, or one or more other techniques used to make containers. For example, container 100 may be formed via extrusion blow molding. Container 100 (e.g., the container body 102) may be formed of one or more of polyolefins (polypropylenes, low, medium and high density polyethylenes). Container 100 may be formed of one or more of polyethylene terephthalate ("PET") (e.g., made via injection stretch blow molding) and/or elastomeric materials. Container 100 may be formed via one or more combinations of the above. In other examples, container 100 may be formed of one or more other materials.

The container body 102 may include one or more walls. For example, as shown on FIGS. 1-3, container body 102 may include a front wall 130, a rear wall 132, a first side wall 134*a*, and a second side wall 134*b*. The first side wall 134*a* and the second side wall 134*b* may extend between the front wall 130 and the rear wall 132. One or more (e.g., each) of the walls, such as one or more of the side walls 134*a*, 134*b*, may include one or more depressions (e.g., depressions within the wall). For example, first side wall 134*a* may include depression 145*a* and second side wall 134*b* may include depression 145*b*. Depression 145*a* and/or depression 145*b* may be located within the second axial segment 162.

One or more of the depressions 145*a*, 145*b* may be delimited by a structure of the container 100. For example, the depressions 145*a*, 145*b* may be delimited by one or more shoulder regions, such as an upper transverse shoulder and/or a lower transverse shoulder. Depression 145*a* may be delimited by an upper transverse shoulder 144*a* and/or a lower transverse shoulder 146*a*. Depression 145*b* may be delimited by an upper transverse shoulder 144*b* and/or a lower transverse shoulder 146*b*. The container 100 may be include one or more depressions to assist in absorbing one or more impacts (e.g., axial impacts) upon the container 100. For example, depressions 145*a*, 145*b* may be configured to absorb an impact upon the top end 106 and/or bottom end 104 of container 100. Depressions of the container may be of many and varied form factors, sizes, and/or number. Depressions (e.g., depressions 145*a*, 145*b*) may include one or more flanges. The flanges of the depressions may have a distal-most surface that extends to a shoulder portion (e.g., an upper and/or lower transverse shoulder). The flanges may extend from one or more edges of a side wall. The flanges may extend from a middle portion of the side wall.

Figure 6:
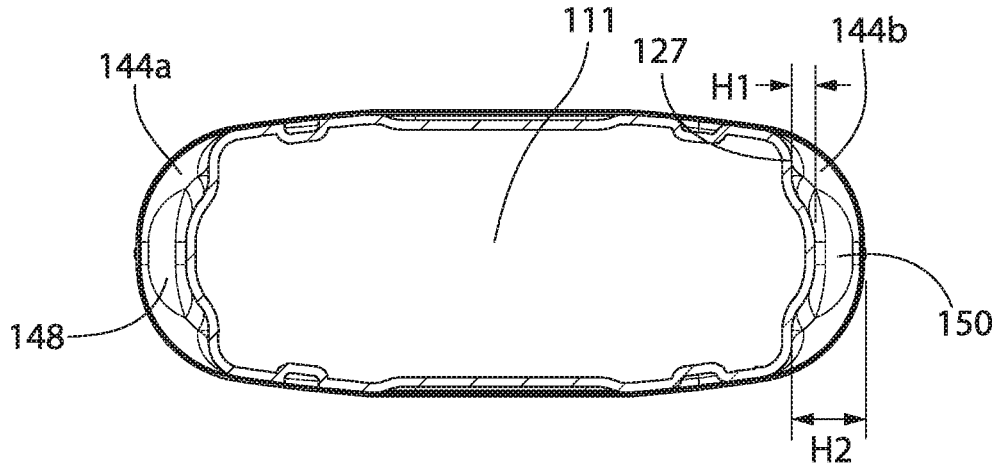
FIG. 6 is partial cross-sectional view of the top of the container shown on FIG. 1.
Figure 7:
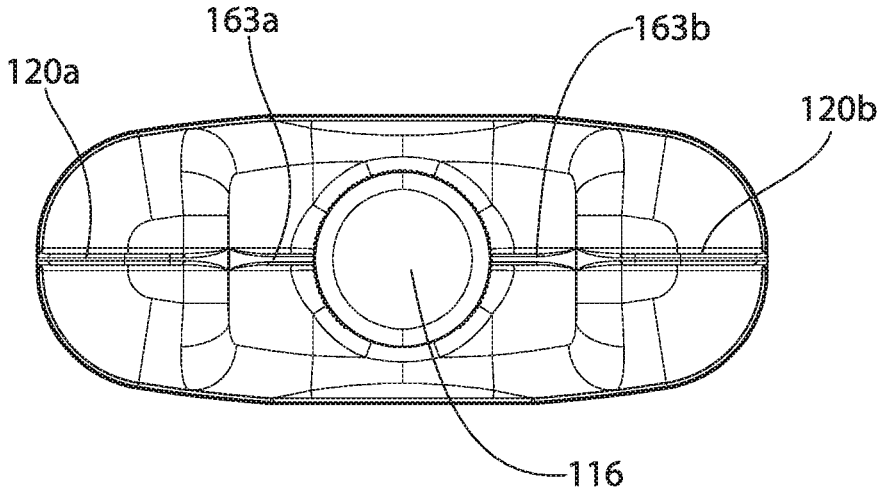
FIG. 7 is a top view of the container shown on FIG. 1.

Container 100 may have a floor, such as floor 127 (shown on FIGS. 4 and 6). One or more (e.g., each) sidewall sections of the container 100 may extend a first height from a floor of a depression. For example, first side wall 134*a* may extend a height H1 from floor 127. The transverse shoulders may extend a second height from the floor of the depression. For example, transverse shoulder 144*a* may extend a second height H2 from the floor 127 of depression 145*a*. First height H1 may be less than second height H2. First height H1, however, may be larger than second height H2, in examples. Having a first height H1 that is different than a second height H2 provides impacting absorbing features to container 100. Although the above describes a first and second height respective to side wall 134*a*, it is understood that a depression may have one or more heights (e.g., H1, H2, etc.) on one or more side walls, including but not limited to sidewall 134*a* and sidewall 134*b*.

One or more segments of the container body 102 may include one or more narrowed sections. For example, as shown on FIGS. 2, 3, 11, and 12, second axial segment 162 of the container body 102 may include the first narrowed section 148 and/or the second narrowed section 150. One or more (e.g., each) of the side walls 134*a*, 134*b* may include a narrowed section. The narrowed section may be configured to absorb one or more impacts upon container 100. The narrowed section may extend between an upper transverse shoulder and a lower transverse shoulder. For example, as shown on FIGS. 3 and 12, first side wall 134*a* may include a first narrowed section 148. The first narrowed section 148 may extend between the upper transverse shoulder 144*a* and lower transverse shoulder 146*a*. Second side wall 134*b* may include a second narrowed section 150. Second narrowed section 150 may extend between the upper transverse shoulder 144*b* and lower transverse shoulder 146*b*, for example of the second side.

Figure 8:
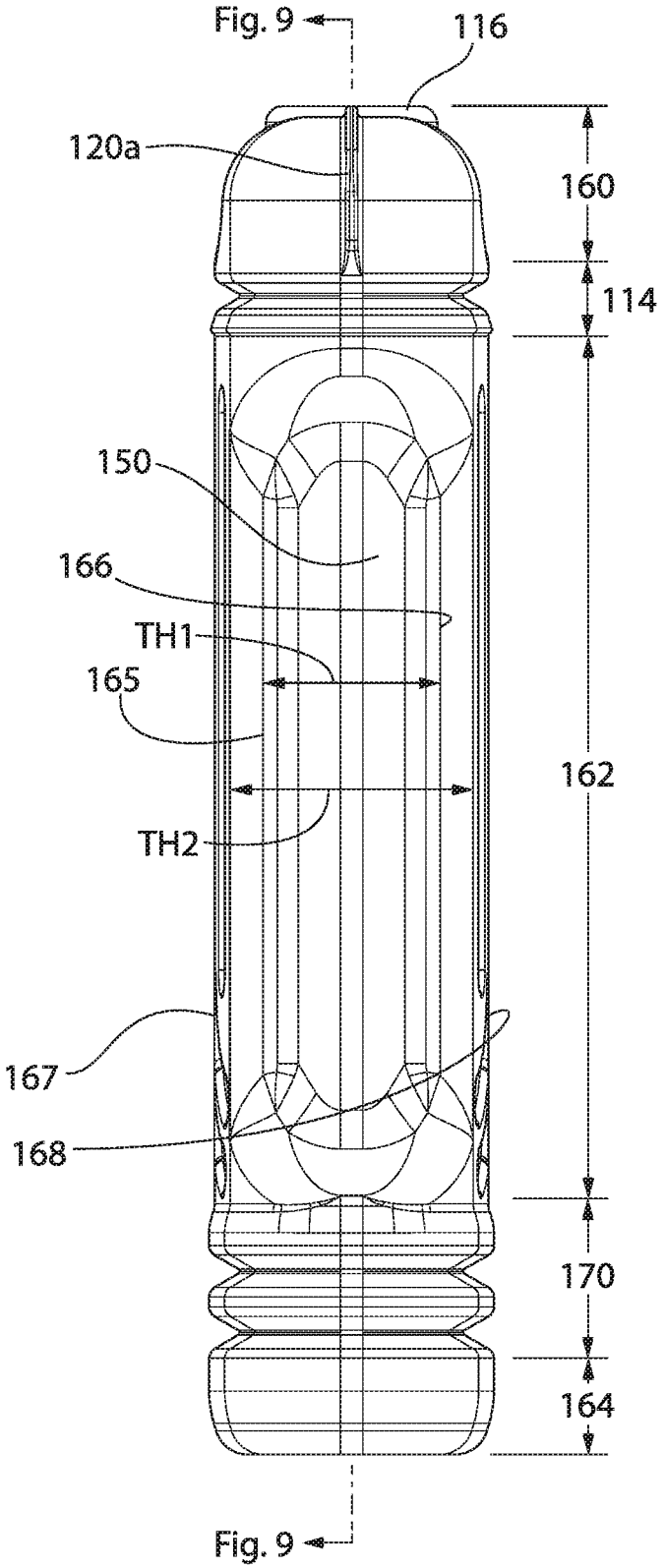
FIG. 8 is a side view of the container shown on FIG. 1.
Figure 9:
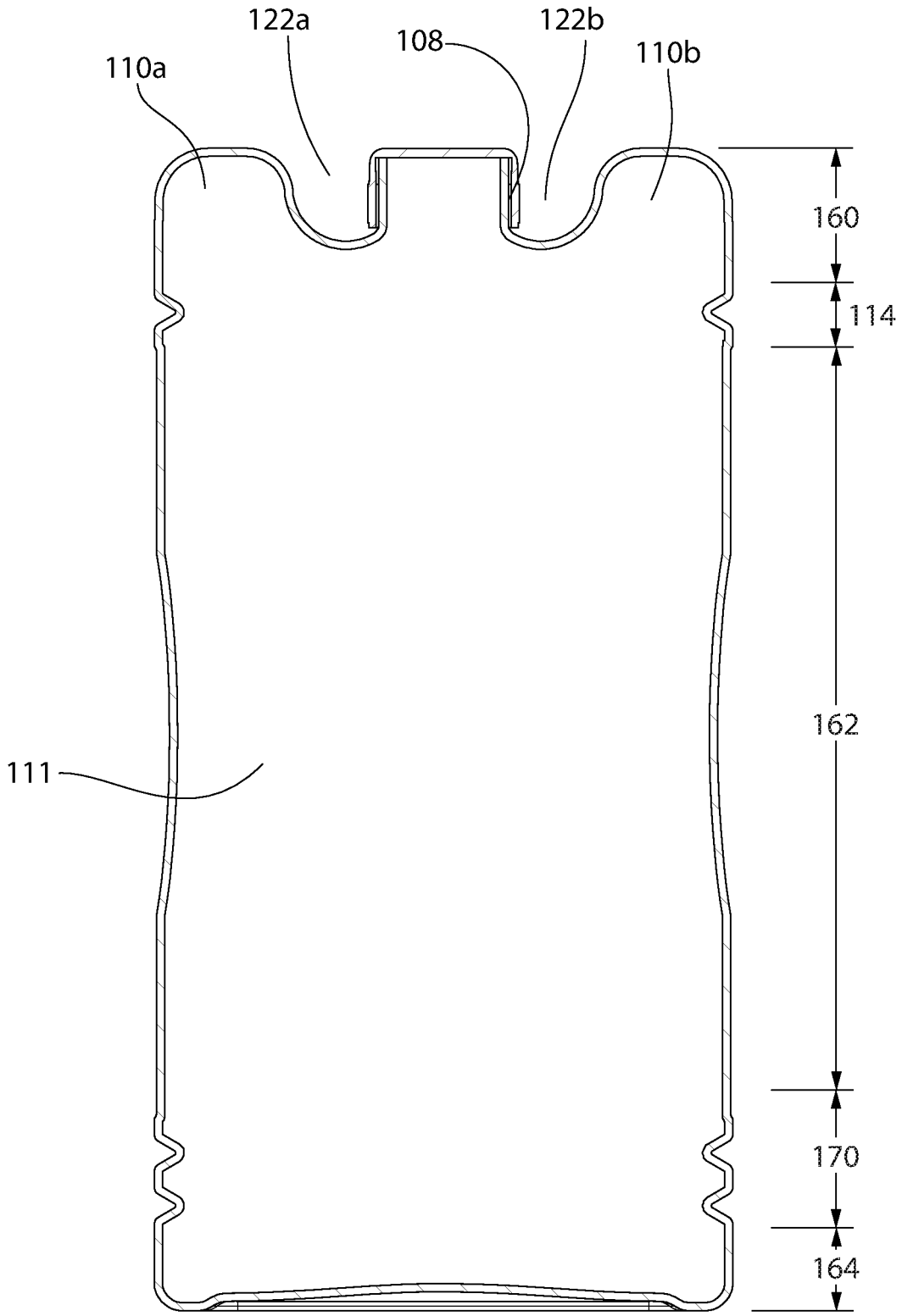
FIG. 9 is partial cross-sectional view of the main surface of the container shown on FIG. 8.
Figure 17:
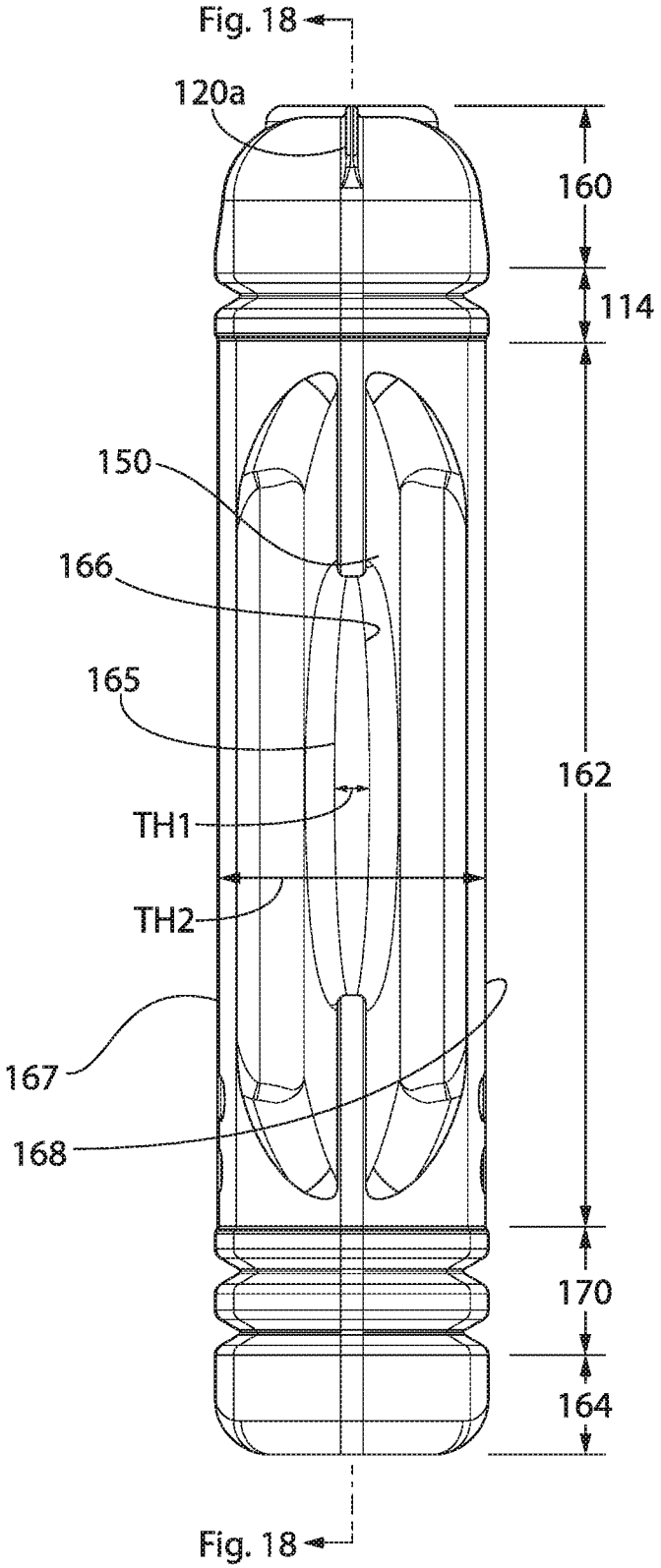
FIG. 17 is a side view of the container shown on FIG. 10.
Figure 18:
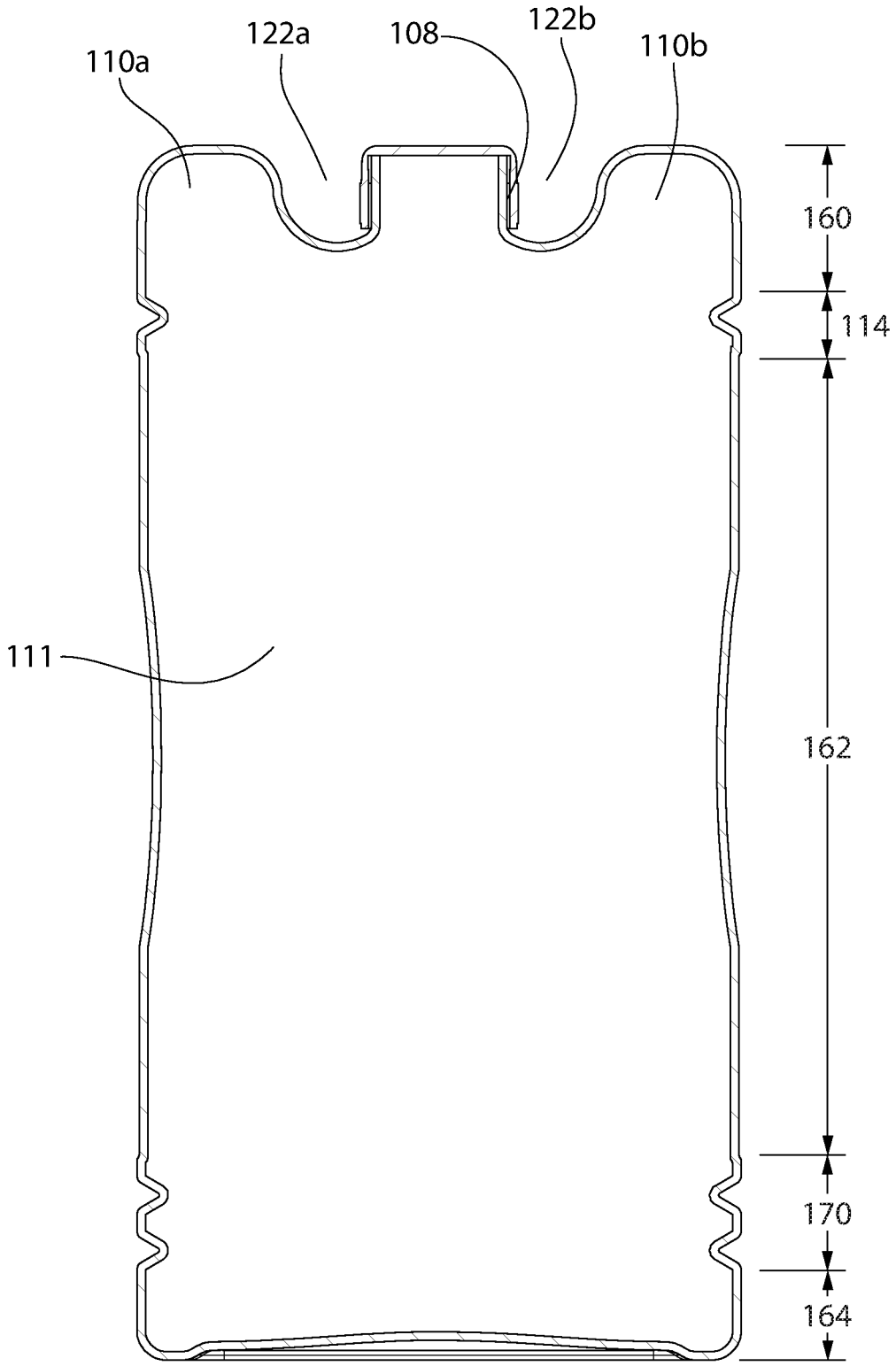
FIG. 18 is partial cross-sectional view of the main surface of the container shown on FIG. 17.

The narrowed sections may have one or more thicknesses. For example, a first thickness may be measured from a front surface of the narrowed section to a rear surface of the narrowed section. The first thickness (e.g., measured from a front surface of the narrowed section to a rear surface of the narrowed section) may be less than the second thickness (e.g., measured from an outer surface of the front wall to a rear surface of the rear wall). For example, as shown on FIGS. 8 and 17, second narrowed sidewall section 150 may have a first thickness TH1 measured from a front surface 165 of the second narrowed section 150 to a rear surface 166 of the second narrowed section 150. The container body 102 may have a second thickness TH2 measured from an outer surface of the front wall 167 to a rear surface of the rear wall 168. In examples, the first thickness TH1 may be less than the second thickness TH2. The first thickness TH1, however, may be larger than the second thickness TH2, in examples. Although one narrowed section is shown on FIGS. 8 and 17, the container 100 (e.g., container body 102) may include one or more narrowed sidewall sections on one or more surfaces and/or sides of container 100. For example, container 100 may include first narrowed sidewall section 148. First narrowed sidewall section 148 may have characteristics, including thickness characteristics, that are similar to, or different than, those described herein for second narrowed sidewall section 150.

The container body 102 may be formed in one or more shapes. The container body 102 may have a three-dimensional shape. For example, the container body 102 may have a three-dimensional rectangular, square, oval, circular, cylindrical, etc., shape. The container 102 may have one or more corners. For example, the container 102 may have four corners. The corners may be rounded corners, linear corners, pointed corners, bumpy corners, and the like.

The container body 102 may include one or more transverse impact absorbing regions. The transverse impact absorbing regions may be configured to absorb a transverse impact upon the container 100. As shown on FIGS. 2 and 11, the container body 102 may include a first transverse impact absorbing region 117 on front wall 130. The first transverse impact absorbing region 117 may be configured to absorb a transverse force applied to the container body 102. The transverse impact absorbing regions may be located in one or more segments of the container body 102. For example, the first transverse impact absorbing region 117 may be located in second axial section 162 of the container body 102.

The impact absorbing regions may include one or more grooves (e.g., transverse grooves), for example, for absorbing transverse impacts upon the container body 102. For example, the first transverse impact absorbing region 117 may include a first transverse groove 115. The first transverse groove 115 may extend (e.g., extend substantially) parallel to the longitudinal axis of the container body 102. A second transverse groove 119 may extend (e.g., extend substantially) parallel to the longitudinal axis of the container body 102. The first transverse groove 115 and the second transverse groove 119 may be located on a front wall 130 of the container body 102. The first transverse groove 115 and/or the second transverse groove 119 may be located on opposite sides of the longitudinal axis.

Container body 102 may include a second transverse impact absorbing region 183. Second transverse impact absorbing region 183, as shown on FIGS. 3 and 12, may be located on a rear wall 132 of the container body 102. Second transverse impact absorbing region 183 may include a third transverse groove 185. The third transverse groove 185 may extend (e.g., extend substantially) parallel to the longitudinal axis of the container body 102. A fourth transverse groove 187 may extend (e.g., extend substantially) parallel to the longitudinal axis of the container body 102. The third transverse groove 185 and the fourth transverse groove 187 may be located on a rear wall 132 of the container body 102. The third transverse groove 185 and/or the fourth transverse groove 187 may be located on opposite sides of the longitudinal axis. The third transverse groove 185 may extend (e.g., extend substantially) parallel to the longitudinal axis of the container body 102. The fourth transverse groove 187 may extend (e.g., extend substantially) parallel to the longitudinal axis of the container body 102. Although third transverse groove 185 and fourth transverse groove 187 are shown on rear wall 132 of container body 102, third transverse groove 185 and fourth transverse groove 187 may be located on any wall of the container body 102.

Container body 102 may include one or more oblique impact absorbing regions. Oblique impact absorbing regions may be configured to absorb axial and/or transverse forces applied to the container 102. For example, the container body 102 may include a first oblique impact absorbing region 123 (on front wall 130) and/or a second oblique impact absorbing region 143 (on rear wall 132). The first oblique impact absorbing region 123 and/or the second oblique impact absorbing region 143 may be configured to absorb axial and/or transverse forces exerted upon the container body 102. The first oblique impact absorbing region 123 and/or the second oblique impact absorbing region 143 may have one or more grooves or sets of grooves, for example, to absorb axial and/or transverse forced exerted upon the container 100.

The sets of grooves of the oblique impact absorbing regions may include one or more pairs of grooves (e.g., inclined grooves), ribs, fins, etc., such as one or more pairs of inclined grooves 125*a*, 125*b* (shown in FIGS. 2 and 11). The first pair of inclined grooves 125*a* and/or the second pair of inclined grooves 125*b* may be located on opposite sides of the longitudinal axis of the container body 102. The first pair of inclined grooves 125*a* and/or the second pair of inclined grooves 125*b* may be located on a front wall 130 of the container body 102. The first pair of inclined grooves 125*a* and/or the second pair of inclined grooves 125*b* may extend substantially parallel to one or more other inclined grooves. The one or more grooves (e.g., of first oblique impact absorbing region 123) may incline and/or may extend in an obliquely inclined manner, for example, relative to the longitudinal axis of the container body 102. The grooves (e.g., inclined grooves 125*a*, 125*b*) may extend along a curved groove axis.

Container 100 may include a third pair of inclined grooves 129*a* and/or a fourth pair of inclined grooves 129*b*. The third pair of inclined grooves 129*a* and/or the fourth pair of inclined grooves 129*b* may extend substantially parallel to one another. In an example, the third and/or fourth pairs of inclined grooves 129*a*, 129*b* may be located on the rear wall 132 of the container body 102. In other examples, however, the third and/or fourth pairs of inclined grooves may be located on any wall of the container body 102, including the front wall 130 of the container body 102. Additional (or less) grooves may be located on the front wall 130 of the container body 102 and/or the rear wall 132 of the container body 102. Although the grooves are defined herein as being in pairs, the disclosure should not be so limiting. The grooves may include a single groove, a pair of grooves, or more.

As provided herein, container 100 may be formed in one or more shapes and/or in one or more configurations. For example, container 100 may be rectangular in dimension. Container 100 may include one or more corners and/or shoulders, for example, to minimize damage when impacted. The corners and/or shoulders of container 100 may be rounded. The shape of the container 100 may facilitate efficient case packing and/or may be robust enough to minimize or eliminate secondary packaging.

The container described herein may be formed of one or more extruded resins, polyolefins (e.g., polypropylenes), polyethylene terephthalates ("PETs"), elastomeric materials, as well as any combination of polyolefins (e.g., polypropylenes), polyethylene terephthalates ("PETs"), and elastomeric materials. Container 100 may be formed of one or more other materials, however, as the materials provided above are examples and for illustration purposes only. The container may be formed by one or more materials (or combinations of materials) and/or one or more methods known to form containers. For example, the container may be formed via extrusion blow molding, injection stretch blow molding, and the like.

As described herein, the container 100 may have a neck, such as neck 108, which may be round. In other examples, neck 108 may take other form factors, such as being linear, square, rectangular, etc. Neck 108 may be elongated or neck 108 may be short. In some examples, neck 108 may be recessed, for example, into the top end 106 of the container 100. The neck 108 may include a retention ring, for example, to accept closure device 116 (e.g., a dispensing cap). Closure device 116 cap may snap on to the neck 108 and/or the closure device 116 may be retained by one or more retention rings of the neck 108, which may be segmented.

In some examples, the top surface of the closure device 116 may be even with (e.g., substantially even with) the top surface of the first 110*a* and/or second 110*b* shoulders of container 100. The top surface of the closure device 116 may be below the top surface of the first 110*a* and/or second 110*b* shoulders of container 100. The top surface of the closure device 116 may be above (e.g., slightly above) the top surface of the first 110*a* and/or second 110*b* shoulders of container 100. The structure of the container 100 may create protection for the neck 108 and/or the closure device 116, which may be more vulnerable than the shoulders 110*a*, 110*b* when the container 100 is subjected to dropping or stacking.

One or more grooves may be placed on, or within, container 100. For example, one or more vertical, diagonal, curved, or/and horizontal grooves may be placed on one or more panels (e.g., front and/or back panels) of container 100. The grooves may be symmetrical (or not symmetrical). The grooves may be designed to absorb and dissipate energy applied to container 100, for example, when container 100 is dropped, stacked upon, or otherwise subjected to shock. The grooves of the container 100 may be extruded or molded from a base surface. The grooves may be configured to absorb and dissipate energy generated by shock. For example, the grooves may be configured in form factors (e.g., thin, thick, parallel, etc.) in a manner that will absorb and dissipate energy generated by shock. The grooves may provide protection for the harsh sorting and shipping logistics of e-Commerce, for example.

Container 100 may be designed to hold and/or transfer different amounts of fluidic, solid, or other substances. As an example, container 100 may be designed to store and/or transfer one liter of the fluidic substance, 200 grams of a powder, 100 tablets, etc. In an example when the container is designed to store and/or transfer one liter of fluidic substances (and/or when the fluidic substance has a weight above sixty-five grams), the container 100 may be able to withstand a vertical top load of 335 N (e.g., a minimum of 335 N) and/or a displacement of 17 mm (e.g., a maximum 17 mm) when force is applied.

The container 100 may have a panel area indicated in the container body 102. An example panel area 199 is shown on FIGS. 10-13. The panel area 199 may be used to receive a label having a surface to communicate brand equity and/or information of the recipient of the product, for example, when the container 100 is sent through an eCommerce distribution. eCommerce distribution is only an example, however. The container 100 may be used for eCommerce distribution and/or brick & mortar channels.

The panel area may include one or more impact absorbing segments and/or regions. For example, panel area 199 may include one or more grooves, bellows, ribs, fins, etc. Although FIGS. 10-13 show panel area 199 being located in the middle of the front surface of container 100, panel area 199 may be located one on one or more locations of container 100.

As described herein, when the container 100 is dropped directly from its top section (or when something is dropped upon the top section of container 100), the maximum stress may be observed on one or more of the grooves provided near the neck 108 and/or at the top of the shoulders 110*a*, 110*b* during impact. The container 100 may dissipate the energy causing little to no damage to the container 100 and/or to the substance stored within the container 100.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A container comprising:

a rectangular container body extending along a central longitudinal axis from a bottom end to a top end, the container body defining an internal cavity for holding a substance, wherein the container body comprises a front wall, a rear wall, and first and second side walls extending between the front and rear walls, the container body comprising:

first and second axial shoulders at the top end;

a neck nesting between the first and second axial shoulders, the neck configured to accept a closure device and having an inner surface that defines a passageway into the internal cavity;

a first axial impact absorbing region configured to absorb an axial force applied to at least one of the first and second axial shoulders, the first axial impact absorbing region comprising one or more first transverse grooves circumscribing the container body;

a first axial segment defining a first portion of the internal cavity, the first axial segment comprising the first and second axial shoulders and the neck;

a second axial segment defining a second portion of the internal cavity, the second axial segment comprising a first transverse impact absorbing region, the first transverse impact absorbing region comprising a first transverse groove extending parallel to the longitudinal axis and a second transverse groove extending parallel to the longitudinal axis, the first and second transverse grooves located on the front wall of the container body on opposite sides of the longitudinal axis; and the first axial impact absorbing region located between and coupling the first and second axial segments to one another, wherein the second axial segment further comprises an oblique impact absorbing region configured to absorb both axial and transverse forces applied to the container body, the oblique impact absorbing region comprising at least one first pair of discrete inclined grooves, each of which extends in an obliquely inclined manner relative to the longitudinal axis and at least one second pair of discrete inclined grooves, each of which extends in an obliquely inclined manner relative to the longitudinal axis, the first and second pairs of discrete inclined grooves located on the front wall on opposite sides of the longitudinal axis of the container body and being axially aligned with one another, a third axial segment defining a third portion of the internal cavity; and a second axial impact absorbing region located between and coupling the second and third axial segments to one another, the second axial impact absorbing region configured to absorb an axial force applied to the third axial segment, the second axial impact absorbing region comprising one or more second transverse grooves circumscribing the container body, wherein the oblique impact absorbing region is located between the first transverse impact absorbing region and the second axial impact absorbing region;

and wherein a first groove of the first pair of discrete inclined grooves has a length greater than a second groove of the first pair of discrete inclined grooves.

2. The container according to claim 1 wherein one or more second transverse grooves are oriented perpendicular to the longitudinal axis.

3. The container according to claim 1 wherein the third axial segment forms a closed bottom portion of the container body, the second axial segment forms a middle portion of the container body, and the first axial segment forms a top portion of the container body.

4. The container according to claim 1 wherein the first axial segment comprises a main body, the first and second axial shoulders extending upward from the main body.

5. The container according to claim 4 wherein the first axial segment further comprises: a first neck rib protruding from a top surface of the main body of the first axial segment and connected to an outer surface of the neck; and a second neck rib protruding from the top surface of the main body of the first axial segment and connected to the outer surface of the neck, the first and second neck ribs located on opposite sides of the neck.

6. The container according to claim 1 wherein a first gap exists between the neck and the first axial shoulder and a second gap exists between the neck and the second axial shoulder.

7. The container according to claim 1 further comprising:

each of the first and second axial shoulders terminating in a distal-most surface; and the neck terminating in a distal-most surface that is located at or below a reference plane that extends between and comprises the distal-most surfaces of the first and second axial shoulders.

8. The container according to claim 7 wherein the reference plane extends perpendicular to the longitudinal axis.

9. The container according to claim 7 further comprising:

a first shoulder rib protruding from a top surface of the first axial shoulder, the first shoulder rib comprising the distal-most surface of the first axial shoulder; and a second shoulder rib protruding from a top surface of the second axial shoulder, the second shoulder rib comprising the distal-most surface of the second axial shoulder.

10. The container according to claim 7 wherein the closure device comprises a distal most surface that is located at or below the reference plane.

11. The container according to claim 1, wherein each of the first and second sidewalls comprises a depression delimited by an upper transverse shoulder and a lower transverse shoulder; wherein the first sidewall comprises a first narrowed section extending between the upper and lower transverse shoulders;

the second sidewall comprises a second narrowed section extending between the upper and lower transverse shoulders of the second side; and wherein the first and second narrowed sections are located in the second axial segment.

12. The container according to claim 11 wherein each of the first and second narrowed sections have a first thickness measured from a front surface of the respective first and second narrowed section to a rear surface of the respective first and second narrowed section, and the container body has a second thickness measured from an outer surface of the front wall to a rear surface of the rear wall, the first thickness being less than the second thickness.

13. The container according to claim 1, wherein the first pair of discrete inclined grooves is oriented in a different direction from the second pair of inclined grooves.

14. The container according to claim 1, wherein an orientation of the first pair of discrete inclined grooves mirrors an orientation of the second pair of discrete inclined grooves.

15. The container according to claim 1, wherein the first and second pairs of discrete inclined grooves are symmetrical about the longitudinal axis.

* * * * *